United States Patent [19]

Steimel

[11] Patent Number: 4,903,904

[45] Date of Patent: Feb. 27, 1990

[54] COMMINUTING DEVICE FOR TURNINGS

[76] Inventor: Richard Steimel, Frankfurter Strasse 135, D-5202 Hennef, Fed. Rep. of Germany

[21] Appl. No.: 352,130

[22] Filed: May 15, 1989

Related U.S. Application Data

[63] Continuation of Ser. No. 681,217, Dec. 12, 1984, abandoned.

[30] Foreign Application Priority Data

Dec. 13, 1983 [DE] Fed. Rep. of Germany ... 8335662[U]

[51] Int. Cl.[4] ..... B02C 13/282

[52] U.S. Cl. ..... 241/154; 241/286

[58] Field of Search ..... 241/32, 36, 154, 152 R, 241/188 R, 191, 290, 286, 287, 288, 289, 241

[56] References Cited

U.S. PATENT DOCUMENTS 3,703,970 11/1972 Benson ..... 241/32 X 4,140,282 2/1979 Steimel ..... 241/154 X

*Primary Examiner*—Mark Rosenbaum

*Attorney, Agent, or Firm*—Michael J. Striker

[57] ABSTRACT

A comminuter for metal turnings has a rotor rotatable on a support about a fixed axis and carrying at least one outer rotor element and at least one inner rotor element which define a cylindrical orbit on rotation of the rotor. A housing surrounds this rotor and is formed by a U-shaped upwardly open portion of non-tapering cross-sectional shape and a flat cover part engageable over the open upper side and openable in order to clear a jam in the machine. Stator elements carried on this housing are spaced slightly from the rotor element so that as the rotor turns turnings fed to the machine will be comminuted and passed from an inlet to an outlet end.

4 Claims, 4 Drawing Sheets

COMMINUTING DEVICE FOR TURNINGS

This application is a continuation of application Ser. No. 681,217 filed Dec. 12, 1984, now abandoned.

BACKGROUND OF THE INVENTION

The present invention relates to a comminuting device for metal turnings with a driven rotor located in the housing of the comminuting device, on which rotor at the outlet side at least one precomminuting arm is placed, whose precommuniting knife cooperates with comminuting bars arranged on the housing and on which rotor on the outlet side a number of peripherally spaced rotor knives of a fine comminuting section are located, the comminuting edges of which cooperate with the comminuting edges of a number of peripherally spaced stator knives in the comminuting device housing.

A comminuting device for metal turnings of this type is to be seen in the German Offenlegungsschrift specification 2,547,980, corresponding to U.S. Pat. No. 4,140,282 in the case of which the comminuting device housing is formed like a letter U or of a trough in cross section at a right angle to the rotor axis and the top flat side of the comminuting device housing is in the form of a door. The inner wall face of the comminuting device housing runs generally parallel to the rotor axis. For this reason the turnings comminuting device does not have any constriction in the direction of the flow of material. The rotor is driven by way of a slipping clutch to prevent damage in the event of an overload or if the rotor is jammed. The drive is so controlled that if the rotor jams, the direction of rotation is reversed so that the rotor may work itself free again. Using such a reversing drive means that even coarse lumps, which have blocked the rotor in the fine comminuting section, are able to make their way to the outlet. However this measure is not always successful, more specially if the lump is larger than the gap between the rotor knife and the stator knife of the fine comminuting section. In such a case the turnings comminuting device has to be turned off and the top door of the housing opened so that the comminuting space may be at least partly emptied by hand and the lump taken out of the comminuting space. Since the turnings have sharp edges, the workers have to wear protective gloves for this work. Such operations are slow and for this reason mean that the plant is at stillstand for some time.

SUMMARY OF THE INVENTION

The purpose of the present invention is to design a comminuting device for turnings in the case of which the removal of a coarse lump jamming the rotor may be undertaken quickly and in a simple way.

Taking as a starting point a comminuting device for turnings of the sort mentioned initially this aim is effected by the present invention inasfar as at least one stator knife in the housing of the comminuting device is guided for radial motion from an operational position into an open position uncovering an outlet for coarse lumps.

If in the comminuting device for turnings in keeping with the invention, the rotor becomes jammed on a lump such as an end piece of a bar, because same is held between a rotor knife and a stator knife, on reversing the direction of turning of the rotor and uncovering the lump outlet the lump will be able to be removed.

The radially moving stator knife is kept in a working position by a power drive, as for example a hydraulic actuator. When jamming occurs and a lump is to be let through the outlet, the radially movable stator knife is moved outwards so that there is then a free passage for the coarse part.

In the case of a turnings comminuting device with a rotor axis at an angle to the vertical, the lump outlet is best placed at the lowest part of the comminuting space.

In the following, an account will be given of working examples of the comminuting device for turnings of the present invention with reference to the figures.

DESCRIPTION OF THE PREFERRED EMBODIMENT

Figure 1:
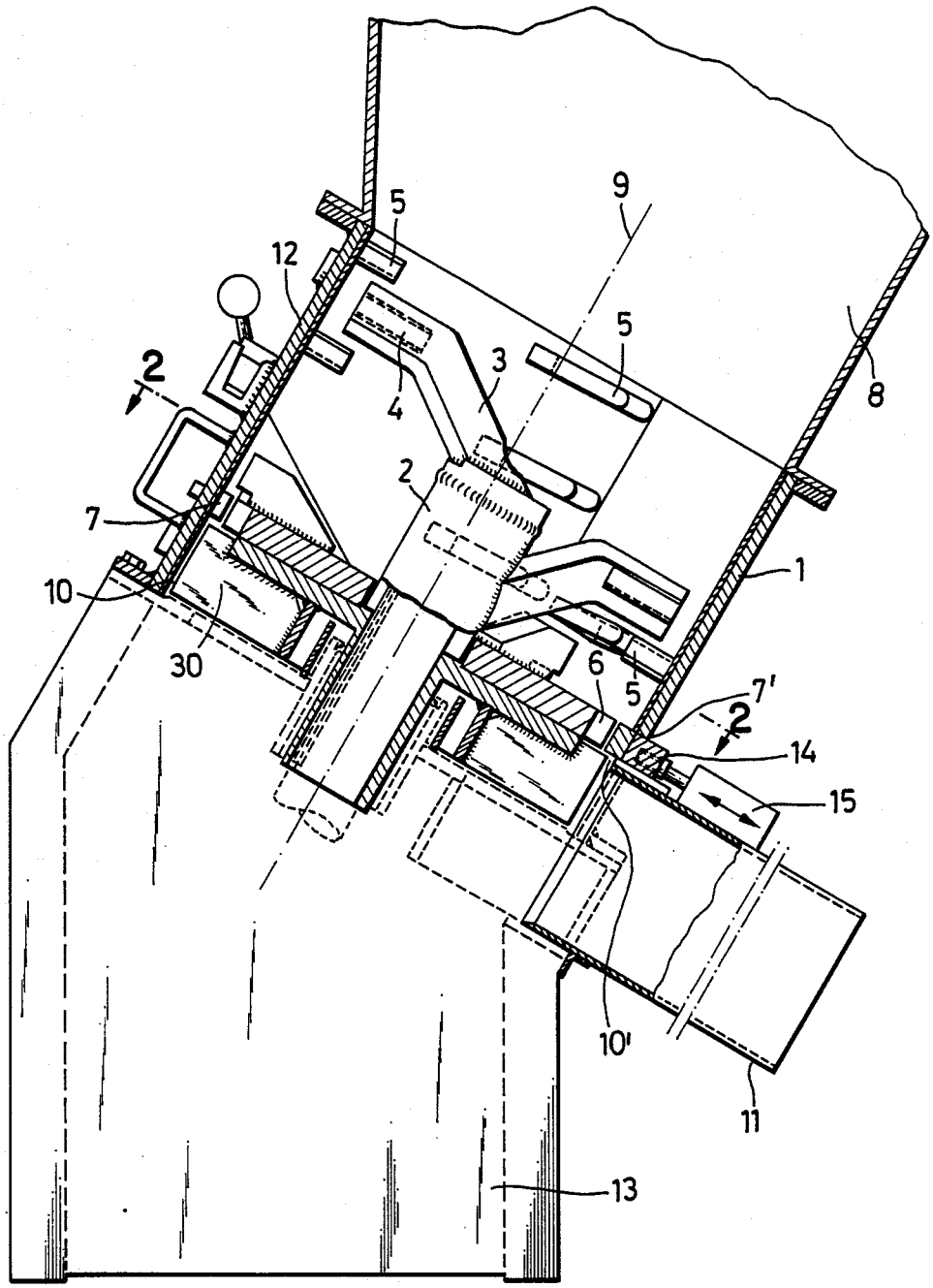
FIG. 1 is a sectional view of the new comminuting device for turnings.

The comminuting device for turnings to be seen in FIG. 1 has a comminuting device housing 1, in which a rotor 2 is bearinged so that it may be driven. Said rotor 2 possesses a precomminuting arm 3 with a precomminuting knife 4, whose comminuting or breaking edges cooperate with the comminuting edges of communiting bars 5, that are fixedly mounted on the comminuting device housing 1. Furthermore there are rotor knives 6 of a fine comminuting section mounted on the rotor 2, the comminuting edges of same cooperating with the comminuting edges of a number of peripherally spaced stator knives 7 in the comminuting device housing 1. The turnings to be comminuted pass through the filling hopper 8 into the comminuting device housing 1, where they are beaten by the precomminuting arm 3 and comminuted or fractured between the comminuting bars 5 and the precomminuting knives 4 moving past same with a clearance. These precomminuted turnings then make their way into the fine comminuting section and are finely comminuted by the rotor knife 6 and the stator knife 7 before passing by way of the outlet space 10 and the outlet chute 11 onto a conveyor belt or into a bin. Since the axes 9 of the rotor and of the housing are inclined, the comminuting space has a deepest point to the side of the point where the shaft passes through the lower wall of the housing. At this lowermost point of the inner face of the comminuting housing 1 the stator knives 7' are mounted so that they may be moved radially. These stator knives 7' are fixed to a block 14, that is acted upon by the piston rod 16 of a hydraulic piston actuator 15.

Figure 2:
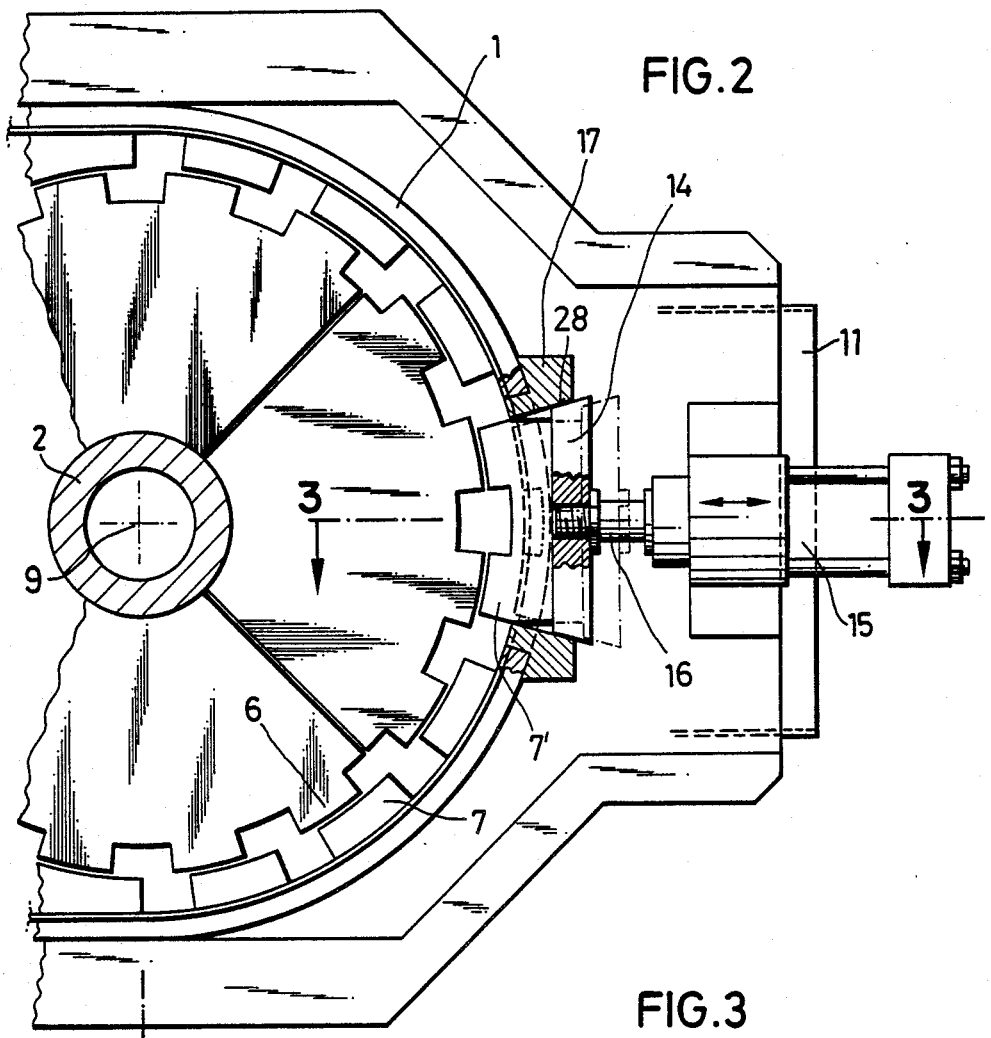
FIG. 2 is a view on the section line II—II of FIG. 1.
Figure 3:
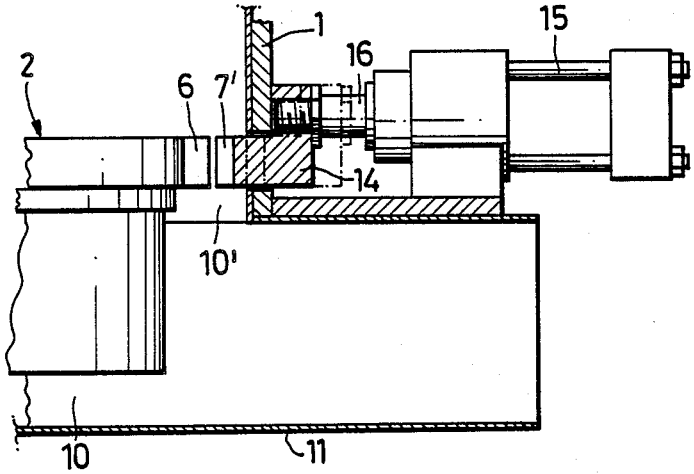
FIG. 3 is a view on the section line III—III of FIG. 2.

As will be seen from FIG. 2, the block 14 is made with converging sides and is pressed into a corresponding converging guide 17, that is mounted on the comminuting device housing 1 and which takes up the shearing forces (at converging faces 28), that act on the stator knives 7'. In this working position to be seen in FIG. 2, the stator knives 7' are hydraulically locked by the actuator 15. In the event of a lump jamming the rotor, such lump may be removed from the comminuting space by opening the lump outlet and reversing the drive of the rotor. The lump or coarse particle may then make its way via the lump outlet space 10' onto the outlet chute 11. After this the stator knives 7' are pressed back into their starting positions and the turnings comminuting device can be operated normally again. The rotor turns for example at a speed of 60 to 80 rpm. In the event of the rotor jamming the rotor drive is reversed three to four times. If this fails to unjam the rotor, the actuator 15 is driven by a pulse of liquid so that the lump outlet space 10' is opened by pulling back the radially movable stator knives 7'. Thereafter the rotor is driven backwards and forwards at a speed of 2 to 4 rpm for example. It has been shown that in most cases this will shift the lump causing the jam to the lump outlet space 10' and move it out of the comminuting space.

If despite opening the lump outlet and despite changing the direction of rotation two or three times the rotor has still not unjammed itself, the turnings comminuting device has to be turned off and the top door 12 of the comminuting space opened.

It is best for the comminuting device for turnings to be fitted with warning devices for producing an optical and an acoustic signal if after opening the lump outlet space 10' and reversing the motor a number of times the rotor has still not been freed.

When the signal sounds, the motor is switched off. After unlocking the top door the same may be opened using a handle so that the comminuting space may be cleared out by hand.

The rotor 2 is fixed on a rotor shaft, that is bearinged by way of a plain bearing and an anti-friction bearing in a frame 13. Between the comminuting housing 1 and the frame 13 there is the outlet chute 11. On the lower side of the rotor there is a wiper 30 turning with it to push the comminuted turnings out of the outlet space 10 and onto the outlet chute 11.

Figure 4:
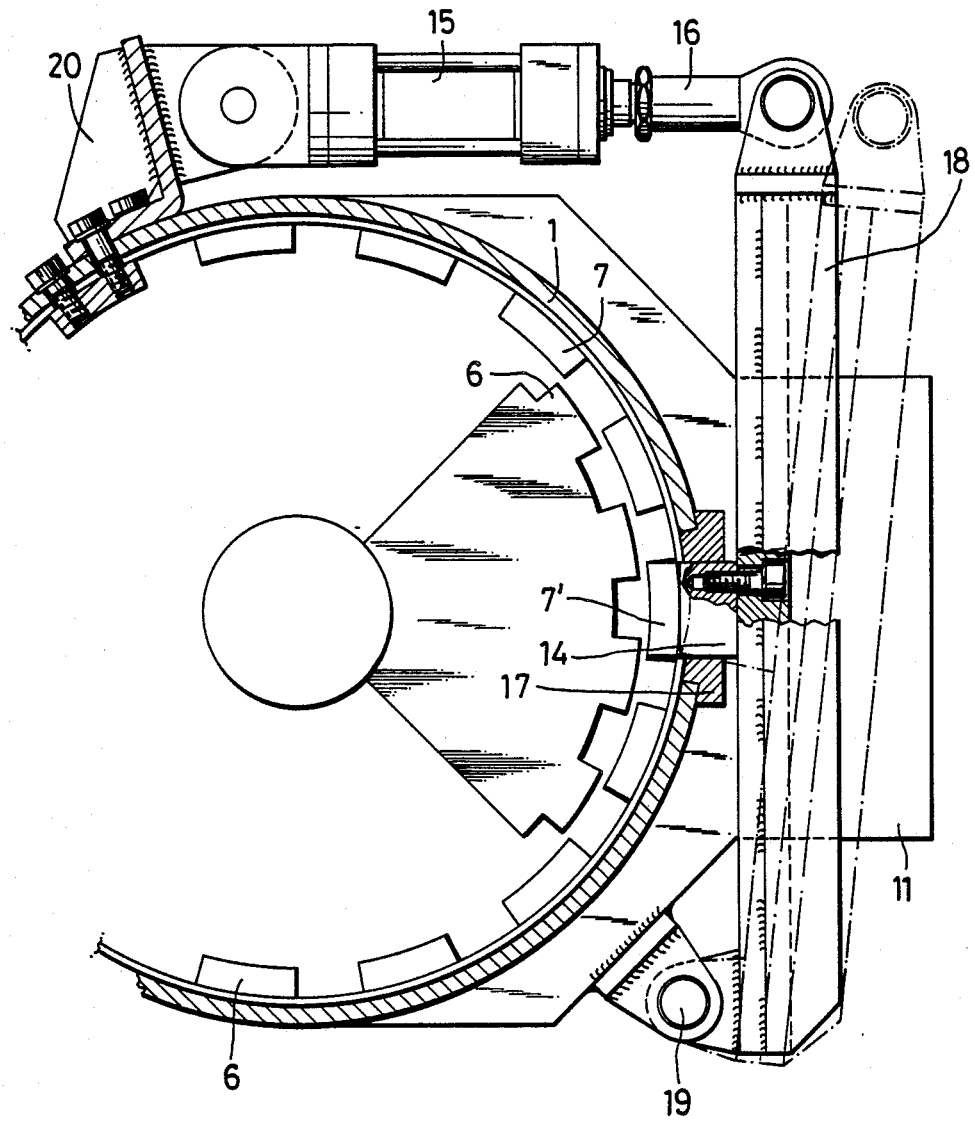
FIG. 4 is a sectional view of a comminuting device for turnings with a stator knife fixed on a lever.

In the working example of the invention to be seen in FIG. 4, only one stator knife 7' is arranged so that it may be moved radially. This stator knife 7' is mounted by way of block 14 on a rigid lever 18, that is pivotally mounted by way of the pin bearing 19 on the comminuting device housing and may be moved by a hydraulic actuator 15 and its piston rod 16 into an opened and into a closed position. To make sure that the shear forces acting on the stator knife 7' during comminution of turnings do not take effect on the bearing 19, the stator 7' and the block 14 joined thereto are mounted in a guide 17, that is placed on the comminuting device housing 1.

The length of the lever 18 is generally equal to the diameter of the turnings comminuting device so that the hydraulic actuator 15 supported on a bracket 20 may be mounted on one side of the turnings comminuting device.

Figure 5:
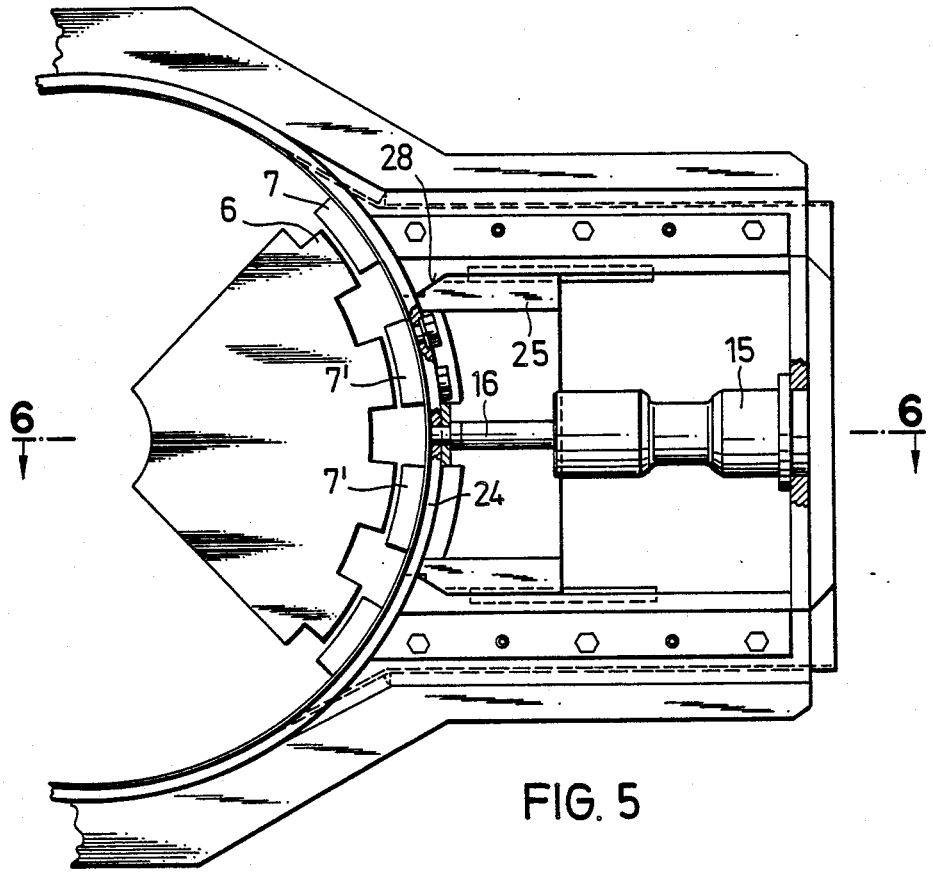
FIG. 5 is a sectional view on the same lines as FIG. 2 with a modified form of the comminuting device for turnings in accordance with the invention.
Figure 6:
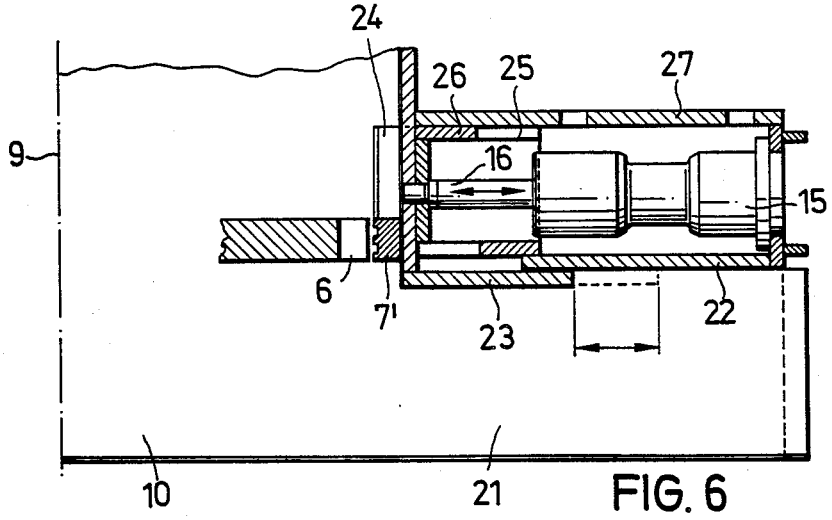
FIG. 6 is a view on the section line VI—VI of FIG. 5.

In the case of the working example to be seen in FIGS. 5 and 6 it is not only the stator knives 7' that may be moved axially but furthermore the wall, next to these stator knives 7', of the comminuting device housing 1 and a part 23 of the upper wall 22 of the outlet port 21.

This makes it possible to considerably increase the free cross section of the opened lump outlet space 10'.

The radially sliding part 24 of the wall of the comminuting device housing 1 and the sliding part 23 of the upper wall 22 of the outlet port 21 together with the guide walls 26 from a slide 25, that is guided in a guide housing 27 for radial motion in relation to the rotor axis 9, which contains the hydraulic actuator 15, whose cylinder part is rigidly fixed to one wall of the housing 27.

I claim:

1. A comminuting device for metal turnings; comprising a housing having an inlet, an inner comminuting space, and an outlet located beneath said inner comminuting space, a rotor located in said inner comminuting space, rotatable in opposite directions, and having at least one arm arranged in a region of said inlet, a plurality of rotary precomminuting knives carried by said one arm, and a plurality of peripherally spaced rotor knives located in a region of said outlet and positioned in a common plane; a plurality of stationary precomminuting knives located in said inner comminuting space, secured to said housing in the region of said inlet, and cooperating with said plurality of rotary precomminuting knives to break the turnings fed through said inlet into precomminuting turnings, a plurality of stator knives located in said inner comminuting space, supported on said housing, located in said common place, and cooperating with said rotor knives to break the precomminuting turnings into fine portions; and a block radially displaceable in said common plane for supporting at least one of said stator knives for outward radial displacement in said common plane to enable delivery of an unbroken coarse lump through said outlet in case of a jamming of the unbroken coarse lump between said one knife and one of said rotor knives, said block having opposite converging outer surfaces, said housing including guide means having complementary converging surfaces cooperating with said opposite converging outer surfaces of said block to guide said block in in its radial displacement in said common plane.

2. A comminuting device according to claim 1, wherein said rotor has an axis inclined to a vertical, said common plane extending transverse to said rotor axis, said comminuting device further comprising a hopper coaxial with said rotor axis.

3. A comminuting device according to claim 1, further comprising means for displacing said block in said common plane and comprising a fluid actuator including a cylinder, a piston displaceable in said cylinder, and a rod connecting said block with said piston.

4. A comminuting device according to claim 3, further comprising a lever pivotably supported on said housing and fixedly connected with said block, said rod being connected to said lever for pivoting the same upon displacement of said piston in said cylinder to thereby radially displace said block in said guide means.

* * * * *